United States Patent [19]

Meyer et al.

[11] Patent Number: 5,023,976

[45] Date of Patent: Jun. 18, 1991

[54] FEED TABLE OF A DRAWFRAME ARRANGEMENT

[75] Inventors: Urs Meyer, Niederglatt; Niklaus Gartenmann, Winterthur; Roland Fischer, Zürich, all of Switzerland

[73] Assignee: Maschinenfabrik Rieter AG, Winterthur, Switzerland

[21] Appl. No.: 431,576

[22] Filed: Nov. 3, 1989

[30] Foreign Application Priority Data

Nov. 3, 1988 [CH] Switzerland ..... 048888/88

[51] Int. Cl.[5] ..... D01G 31/00

[52] U.S. Cl. ..... 19/0.25; 19/243; 19/144; 19/296

[58] Field of Search ..... 19/0.25, 0.151, 145, 19/144, 236, 239, 240, 243, 244, 246, 288, 296, 299

[56] References Cited

U.S. PATENT DOCUMENTS

| | | | |
|---|---|---|---|
| 3,063,101 | 11/1962 | Andreani | 19/243 |
| 3,310,844 | 3/1967 | Robertson | 19/0.25 |
| 3,330,007 | 7/1967 | Foster | 19/0.25 |
| 3,445,894 | 5/1969 | Rayfield et al. | 19/0.25 |
| 3,447,206 | 6/1969 | Klein et al. | 19/243 |
| 3,562,867 | 2/1971 | Kaiser | 19/243 |
| 3,657,773 | 4/1972 | Whitehurst | 19/243 |
| 4,412,367 | 11/1983 | Clement et al. | 19/0.25 |
| 4,443,913 | 4/1984 | Klazar | 19/159 A |
| 4,577,372 | 3/1986 | Roder | 19/159 A |

FOREIGN PATENT DOCUMENTS

| | | | |
|---|---|---|---|
| 129746 | 1/1985 | European Pat. Off. | 19/236 |
| 2230644 | 2/1975 | Fed. Rep. of Germany . | |
| 3518453 | 11/1985 | Fed. Rep. of Germany | 19/236 |
| 858326 | 11/1940 | France | 19/246 |
| 383228 | 12/1964 | Switzerland . | |
| 17060 | of 1900 | United Kingdom | 19/0.25 |
| 402314 | 11/1933 | United Kingdom | 19/236 |
| 1540491 | 2/1979 | United Kingdom . | |

*Primary Examiner*—Werner H. Schroeder
*Assistant Examiner*—Michael A. Neas
*Attorney, Agent, or Firm*—Dority & Manning

[57] ABSTRACT

The invention relates to a feed table for feeding slivers by way of a conveyor to a textile processing machine. The slivers are drawn off from associated spinning cans by way of draw-off devices and placed on the conveyor. In the event of a sliver running out or breaking, reserve slivers are fed in automatically by way of draw-off devices specifically devised for this purpose. The conveyor comprises individual conveyor belts associated with each sliver and each reserve sliver and have a draw-off devices, each conveyor belt being drivable by way of a controllable drive, the conveyor belts being a part of the draw-off devices.

31 Claims, 7 Drawing Sheets

FEED TABLE OF A DRAWFRAME ARRANGEMENT

The invention relates to a feed table for feeding slivers by way of a conveyor to a textile-processing machine.

Arrangements are known wherein individual slivers are drawn out of the spinning cans by way of roller pairs disposed thereabove and supplied by way of a number of support rollers or other guide means to a subsequent textile-processing machine, for example, a drawframe. The slivers are combined therein to form a web and supplied by a pair of rollers to the drawframe.

A disadvantage of such facilities is that the slivers are guided only at a few places along their feed path and sag freely elsewhere. There is, therefore, a risk of the slivers tearing between the individual guides.

When a sliver breaks or runs out, the drawframe must be stopped and a new sliver fed in manually.

DE-AS 2 230 644 discloses an apparatus which obviates some of these disadvantages and, in which the sliver to be processed, referred to herein briefly as the "sliver", is drawn off from a spinning can by way of draw-off rollers and placed on a conveyor belt for forward conveyance. A reserve can is associated, in line, with each operating can to form a pair. The sliver of the reserve can, hereinafter briefly called the "reserve sliver", is retained in a standby position by way of a pair of draw-off rollers. The draw-off roller pairs for the sliver and for the reserve sliver are, as considered in the direction of conveyance, disposed in line one after another. In the event of a sliver breaking or running out, control mechanism acts to start the draw-off means of the associated reserve sliver.

This ensures automatic feeding-in of a reserve sliver in the event of a sliver breaking or running out.

A disadvantage of this construction is that the slivers and reserve slivers experience a number of sharp deflections before being guided onto the conveyor belt.

The risk of a sliver breaking is, therefore, increased and there is a substantial evolution of dust. Also, the conveyor belt has no lateral guidance for the slivers or the reserve slivers, so that problems may arise when a reserve sliver has to be fed in or joined onto the sliver.

SUMMARY OF THE INVENTION

It is the object of this invention to obviate the disadvantages of the known arrangements and to provide an apparatus and a method where a sliver or a reserve sliver can be placed on a conveyor without substantial deflections in its path, remains in the predetermined conveyance position, and is suitable for the controlled feeding-in of a reserve sliver.

According to the invention, to provide a simple feeding-in of the reserve slivers the conveyor belts for the slivers and the conveyor belts for the reserve slivers are disposed parallel to one another and in pairs.

Advantageously, these paired conveyor belts are controlled by a common control.

The use of individual conveyor belts enables the lengths of the conveyor belts to be such as not to exceed the necessary dimension, i.e., it is proposed that each individual conveyor belt begins above the associated spinning can and terminates at a common delivery station.

The moving parts of the conveyor belt can, therefore, be kept to a necessary minimum, so that less driving power is required and there is less eddying of dust.

Having the deflecting or reversing rollers of the conveyor belts at the entry cooperate with pivoted pressing rollers to form draw-off means for the slivers leads to a compact arrangement, and the slivers are guided directly onto the conveyor belt for forward conveyance without substantial deflections.

A further embodiment of the invention provides two rows of sensors to detect the sliver end and the sliver start and facilitate satisfactory control of the feeding of the slivers and of the automatic feeding-in of the reserve slivers.

According to another embodiment of the invention, to make the start of a fed-in reserve sliver converge on a running-out sliver, guide means for producing such convergence are provided after the delivery station of the conveyor belts.

Driving the conveyor belts by way of clutches disposed coaxially on a common drive shaft leads to a compact and simple drive.

Advantageously, for accurate positioning of the slivers, brake facilities are associated with the individual clutches.

Of special significance is the inventive concept of mounting the individual conveying belts on respective special frame work portions or supports. The frame work can then be assembled from modules depending upon the prevailing requirements. In this respect, it has proved advantageous that the individual support has, at one end, a drive roll and, at the other end, a diverting or deflecting roll. Both the latter and the drive roll can be made axially movable on the support to form tensioning rolls for the conveying belt.

The support is preferably manufactured as a tubular section with a U-shaped section mounted thereon. One run of the conveying belt can be movably mounted in a protective manner in the interior of the U-shaped section.

For the other run of the conveying belt, a tubular or trough-shaped projection is provided below the tubular section, and also support rolls are provided in order to prevent sagging.

It is of special significance that the support can be assembled from axial support sections which are jointly enclosed by the conveying belt; these support sections are prefabricated in predetermined variable lengths comprising, preferably, a basic length, one and a half times the basic length, and a double length.

Several parallel supports are grasped by at least one common transverse carrier as a part of the frame of the feed table so that this frame is assembled from only few individual components.

In accordance with a further embodiment of the invention, the drive of the conveyor belt is provided in a drive unit mounted as a module on the support. The drive unit comprises a drive roll, projecting into the return section of the conveyor belt. In order to improve feeding in of the fiber sliver, at least one pressure roll is pivotable onto the circumference of the drive roll. The pressure roll forms a part of the drive unit, is mounted externally of the drive unit on the support thereof, or on the adjacent support which projects over the first mentioned support in a direction opposed to the transport direction.

Further advantages, features and details of the invention will be apparent from the following description of preferred embodiments and from the drawings.

BRIEF DESCRIPTION OF THE DRAWINGS

These show the following schematic illustrations.

DETAILED DESCRIPTION OF THE INVENTION

Figure 1:
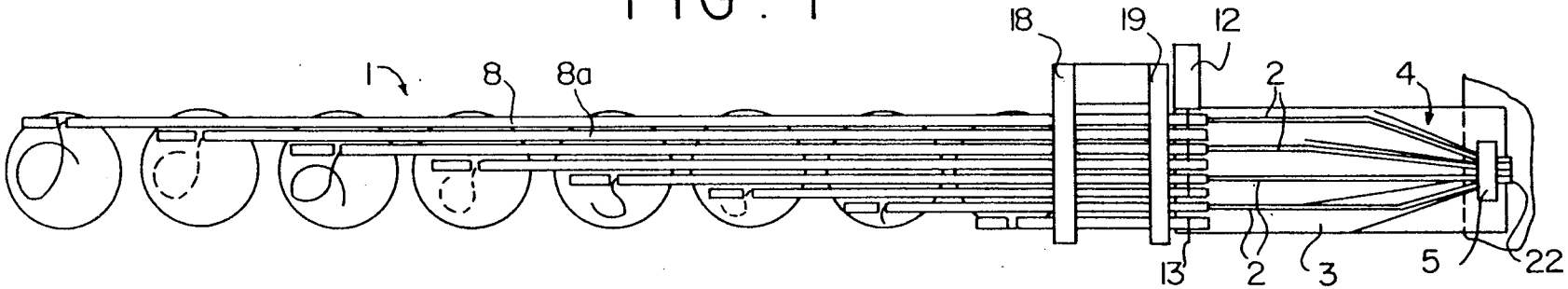
FIG. 1 is a plan view of a feed table of a textile machine with conveying belts of varying lengths arranged parallel to each other.
Figure 2:
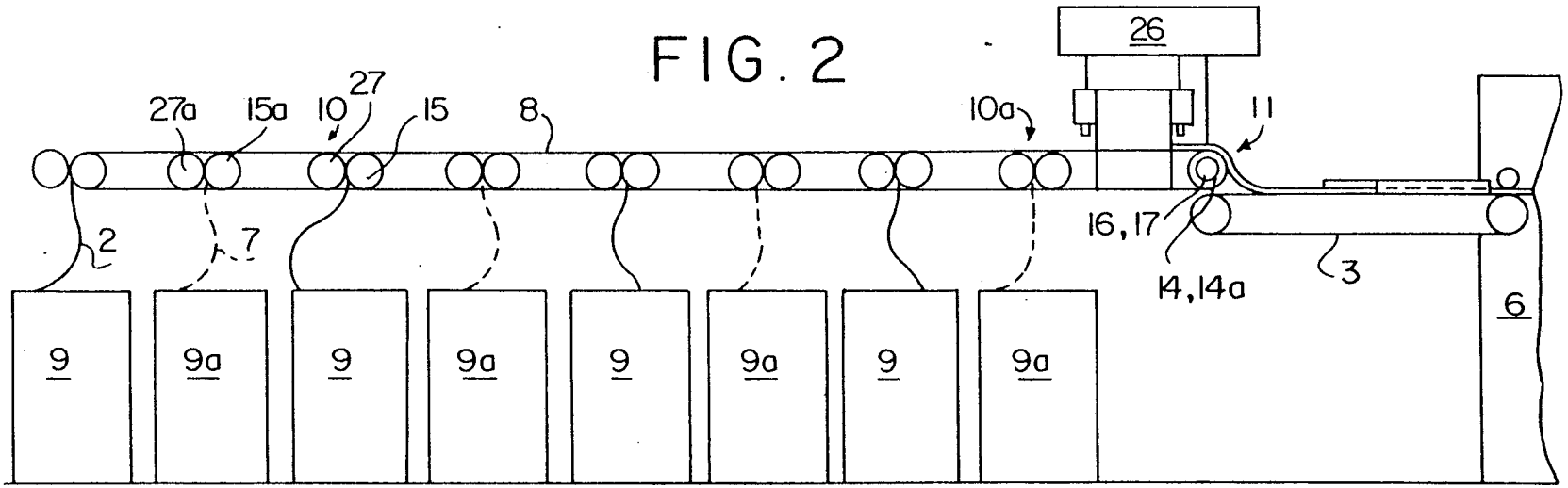
FIG. 2 is a side view of the arrangement according to FIG. 1.

The individual slivers 2 and reserve slivers 7 are drawn out of respective spinning cans 9, 9*a* by means of respective draw-off roller pairs 10, 10*a* and move onto individual conveyor belts 8, 8*a*, respectively (as seen in FIGS. 1 and 2).

The belts 8, 8*a* extend to a common delivery station 11. The belts 8, 8*a* are driven by a motor 12, driving a transverse drive shaft 13. The belts 8, 8*a* have inwardly directed toothed profiles which are not shown in great detail and which mesh with the external toothed profile of a driving roller 14, 14*a* and drawoff roller 15, 15*a*.

The drive connection between the shaft 13 and the rollers 14, 14*a* is by way of individual clutch units (not shown in greater detail) in the drive rollers. To stop the various belts 8, 8*a* brake devices (not shown in detail) are provided in addition to the various clutches.

For the sake of clarity, the connections to the stationary machine frame of the various bearings or units are not shown.

Figure 3:
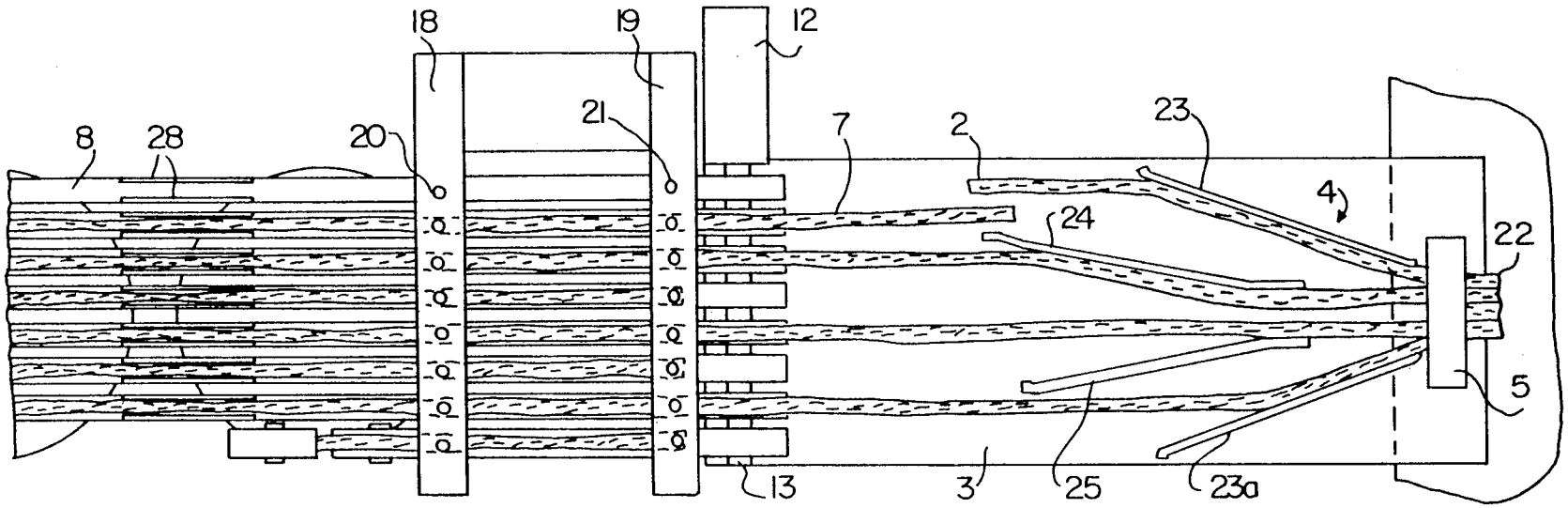
FIG. 3 is a plan view, on a larger scale than that used in FIG. 1, of a transfer region between the conveyor belts of the feed table and a transport belt following the conveyor belts.

Two rows of sensors 18, 19 are disposed across and above the conveyor belts 8, 8*a* between the delivery station 11 and the draw-off roller pair 10*a* nearest the drawframe. The rows 18, 19 have sensors 20, 21 sensing the various slivers 2, 7, as can be seen in FIG. 3. Disposed further on, and below the delivery station 11, is a conveyor belt 3 on which the slivers 2 are placed and supplied by way of a feed condenser 4 and a conveying roller 5 to a drawframe.

The condenser 4 condenses the parallel moving slivers 2 into a web 22 at the roller 5.

Guide plates 24, 25 are provided above the conveyor belt 3 in addition to the lateral guides 23, 23*a* of the condenser 4.

The lateral guides 23, 23*a* and/or the guide plates 24, 25 could also be guide belts rotating around vertical axes.

The drive for the belt 3 is derived from the drive of the motor 12 (not shown). The sensors 20, 21, the clutches 16, the brake devices 17 and the motor 12 are connected for control purposes to a control unit 26.

The control or operation of this facility is as follows:

With the motor 12 on and the clutches 16 engaged, the slivers 2 are placed on the rotating conveyor belts 8; the slivers 2 are moved automatically or manually between the draw-off roller pairs 10, the clamping rollers 27 being pivotable or displaceable.

The slivers thus placed on the rotating belts 8 move consecutively or simultaneously into the detection zone of the sensors 21 of the row 19. The drive of the belts 8, i.e., the control of the clutches 16, is actuated so that when a sensor 21 detects the leading end of a sliver, the clutch of the corresponding conveyor belt 8 disengages and the same is stopped immediately by the corresponding brake device. An accurately defined initial position of the sliver leading end is therefore ensured.

The control is such that when the sensors 21 have detected all the leading ends of the slivers, all the clutches 16 of the belts 8 re-engage simultaneously and their brake devices release simultaneously. This ensures that all the slivers 2 arrive simultaneously on the conveyor belt 3. Conveyor belts convey the slivers 2 forward to a conveying roller 5 which delivers the slivers 2, combined to form a web 22, to a drafting arrangement (not shown in detail). On their way to the roller 5 the slivers 2 enter a condenser 4 whose side guides 23, 23*a* cause the slivers 2 to converge. Further guide plates 24, 25 to guide the slivers 2 and the reserve slivers 7 are disposed in the condenser 4.

The reserve slivers 7 drawn out of the cans 9*a* pass like the slivers 2 by way of a draw-off roller pair 10*a* to the conveyor belts 8*a*. Conveyance of the reserve slivers 7 is interrupted, i.e., the clutches 16 of the conveyor belts 8*a* disengage, whenever the sensors 21 associated with the conveyor belts 8*a* detect the leading end of a reserve sliver 7. When the clutches 16 of the belts 8*a* disengage; the operative brake devices 17 stop the belts 8*a* very rapidly.

The starting of any of the conveyor belts 8*a*, i.e., the feeding-in of a reserve sliver 7, occurs only when the sensor row 18, i.e., the sensors 20, detects the run-out or interruption of a sliver 2.

The starting of the belts 8*a* is delayed by an amount depending upon the distance between the sensor rows 18 and 19.

For lateral guidance of the slivers 2, 7 on the belts 8, 8*a* the provision of guides 28 above the conveyor belts are provided. The corresponding guides 28 are rigidly connected to a frame part and are disposed over some or all of the length of the belts 8, 8*a*. The guides 28 might, in some circumstances, have an additional guide for the conveyor belt.

Another embodiment of lateral guidance of the slivers and reserve slivers is for the conveyor belts 8, 8*a* to have rotating guides disposed on them.

The piecing-up of the reserve slivers 7 by way of the draw-off roller pair 10*a* can proceed simultaneously with the piecing-up of the slivers 2.

Figure 1A:
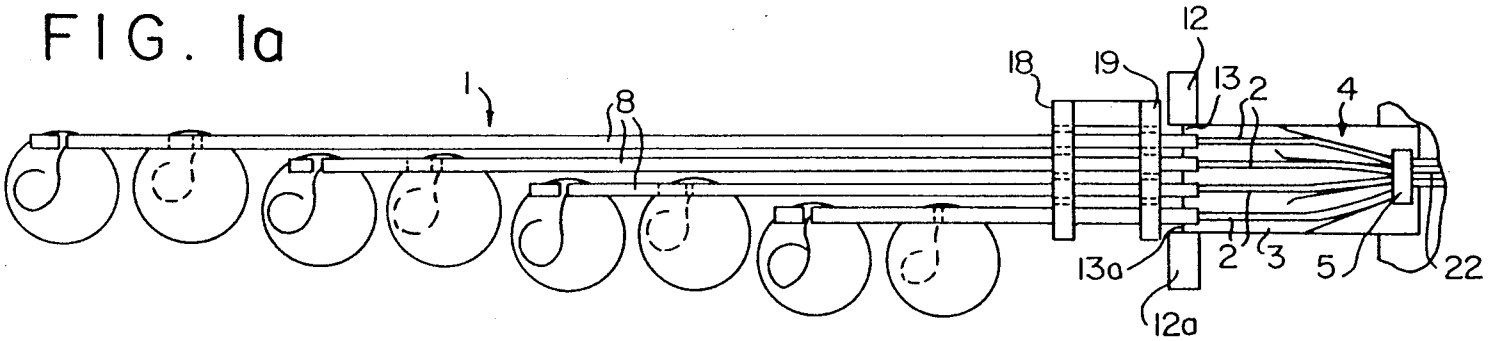
FIG. 1*a* is a plan view of another embodiment of the invention wherein the conveyor belts are disposed on two vertical levels.
Figure 2A:
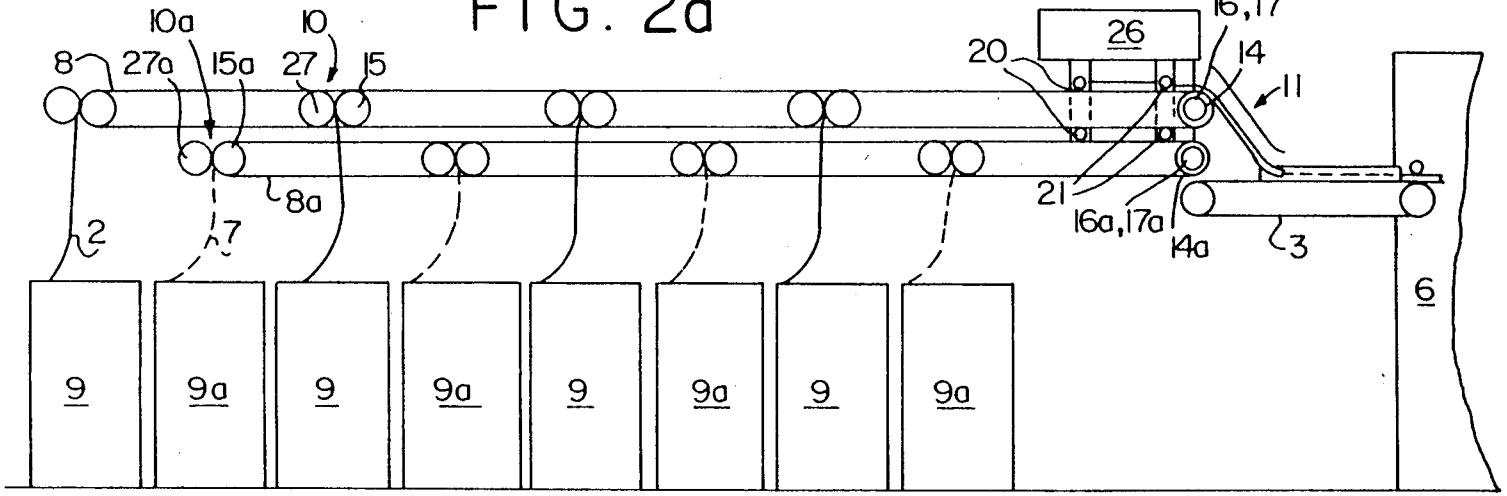
FIG. 2*a* is a side view of the arrangement according to FIG. 1*a;*

Referring now to FIGS. 1*a* and 2*a* wherein conveyor belts 8 are arranged vertically above conveyor belts 8*a* with the reserve slivers being conveyed by conveyor belts 8*a*. Conveyor belts 8 and 8*a* deliver their slivers to a common delivery station 11, in the same manner as in the embodiment of FIGS. 1 and 2. In this embodiment, two rows of sensors 18, 19 are disposed on each level of conveyors.

FIG. 3 shows the running-out of a sliver 2 and the feeding-in of a reserve sliver 7. The actual piecing-up of the spare sliver 7 to the running-out end of the sliver 2 is performed when the reserve sliver 7 reaches the side guide 23 of the condenser 4. In the example shown, the arrival on the side guide 23 is associated with a slight overlapping between the end of the sliver 2 and the leading end of the reserve sliver 7.

Another embodiment is to butt-join the start of the reserve sliver 7 to the running-out end of the sliver 2.

Also, additional horizontal or vertical pressing rollers may be provided near the place where the slivers and reserve slivers converge, with a view to increasing the adhesion of the joint between them. After the piecing-up of the reserve sliver 7, it becomes a sliver 2 and a new reserves sliver 7 is fed in manually or automatically on the now empty conveyor belt 8. The start of the new reserve sliver moves into he region of the sensor 21 so that, as previously described, the drive of the corresponding belt 8 is interrupted and the new reserve sliver 7 remains in this standby position.

As can be gathered from the procedure hereinbefore described, the sensor row 19 is effective to detect the leading end of the sliver and the sensor row 18 is effective to detect a running-out sliver 2, 7.

Another embodiment is for the sliver end to be detected as early as the roller pair 10, 10*a*, in which event the first sensor row 18 could be omitted.

The various conveyor belts 8, 8*a* need not necessarily be guided parallel to one another but can be guided so as to converge towards the delivery station 11, or to radiate therefrom.

Figure 4:
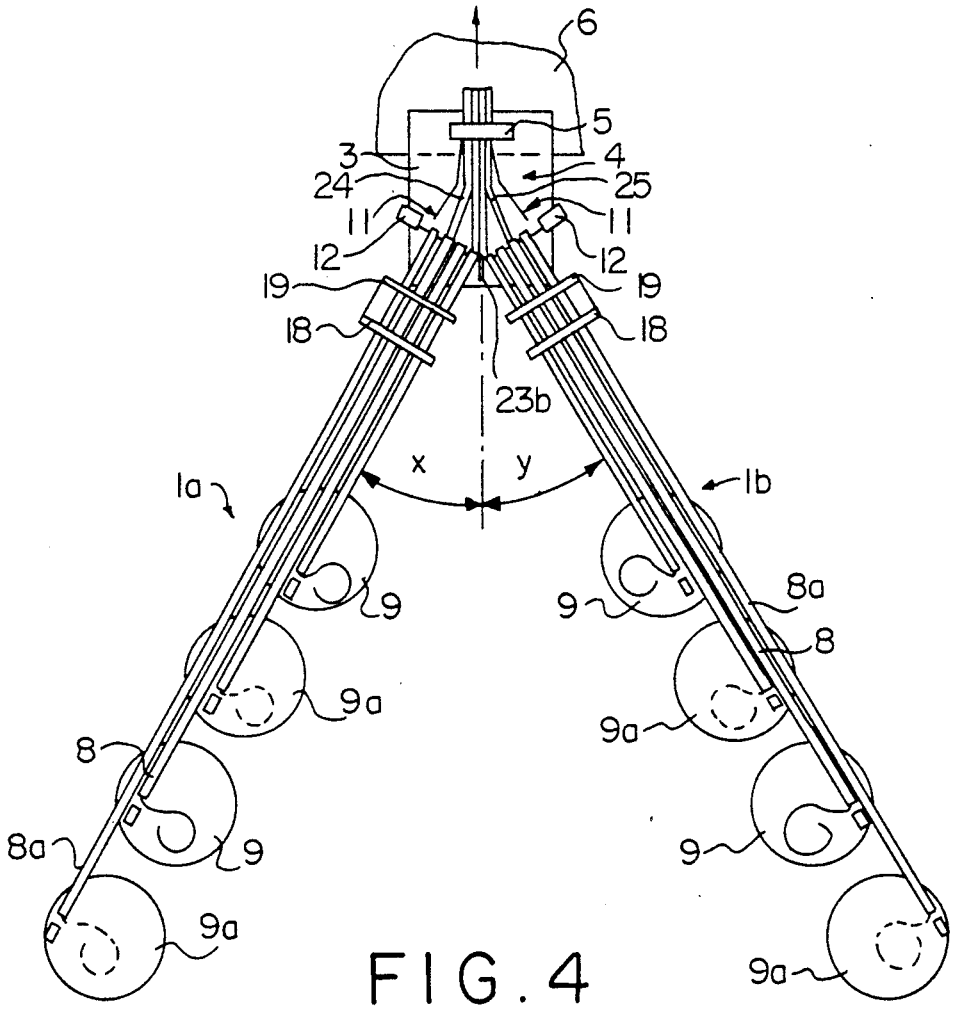
FIG. 4 is a plan view of two feed tables with a common transfer region.
Figure 5:
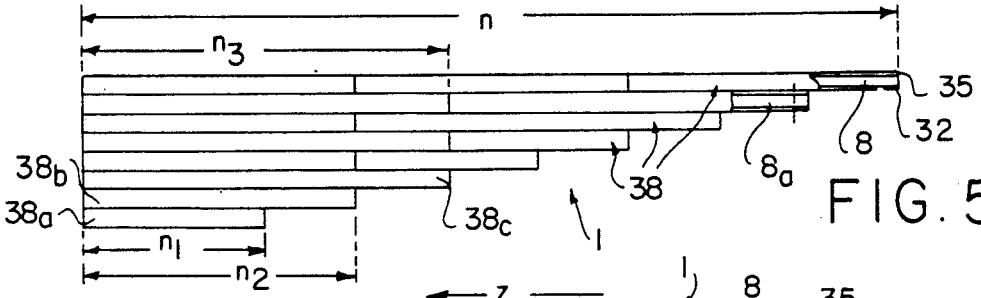
FIG. 5 is a schematic plan view of a feed table comprising supports, assembled from modules, for the conveyor belts, which have been only partially illustrated.
Figure 6:
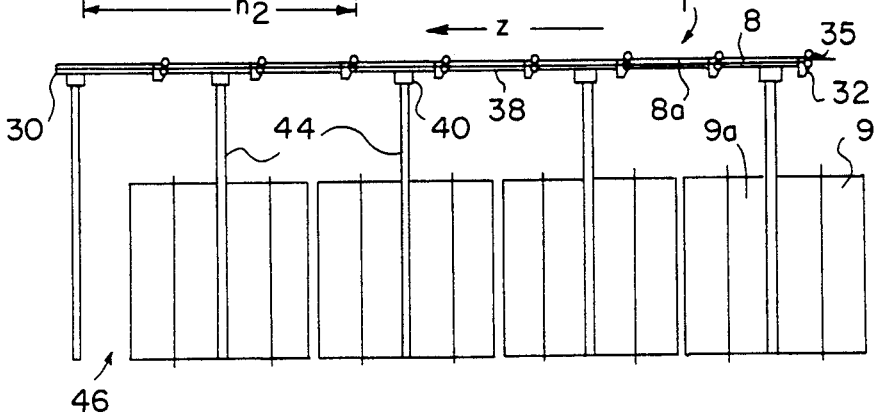
FIG. 6 is a side view, on a smaller scale, of an arrangement according to FIG. 5 with the supports forming parts of a frame.
Figure 7:
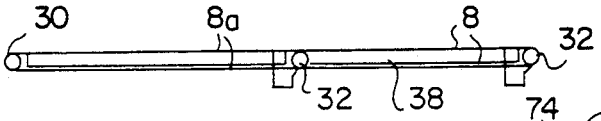
FIG. 7 is an enlarged detail from FIG. 6 showing two modules.
Figure 8:
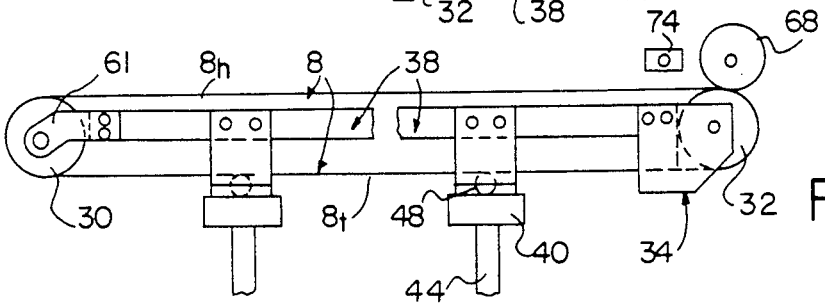
FIG. 8 is an enlarged detail from FIG. 7.
Figure 9:
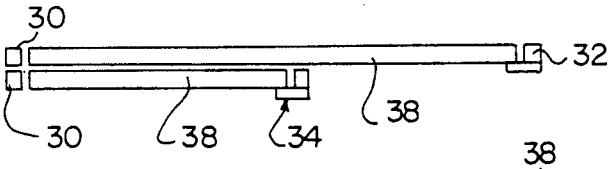
FIG. 9 is a plan view of FIG. 7.
Figure 10:
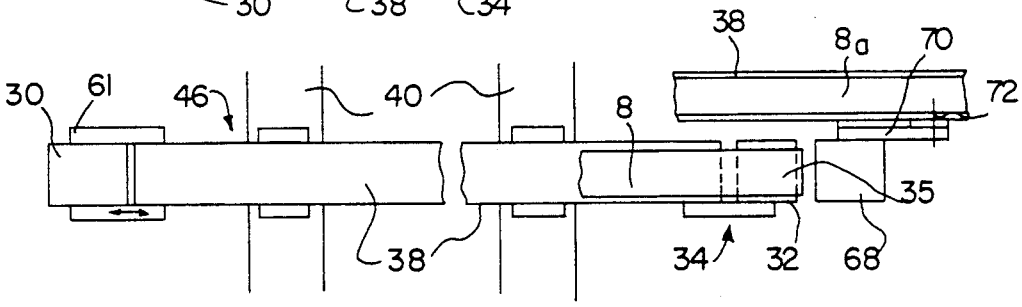
FIG. 10 is a plan view of FIG. 8.

FIG. 4 shows a corresponding embodiment in which the feed table has been divided into two segments 1*a*, 1*b* arranged to diverge from one another at an angle x and y respectively to the feed direction into the drawframe 6. The angles x, y can be up to 90°. In the latter case the deflection in the feed zone to the drawframe 6 is also 90° and calls for a known device to change the feeding direction or some other special kind of deflecting facility.

In the example shown in FIG. 4, the angles x, y are each in the range of approximately 30° so that the provision of guide plates 23*b*, 24, 25 suffices for entry into the drawframe 6, i.e., to make the slivers and reserve slivers converge. Since the slivers are fed at an angle x or y, a central guide plate 23*b* is necessary to ensure a parallel entry of the slivers into the drawframe.

In contrast to FIG. 1, a sensor row 18, 19 and a drive motor 12 are associated with each feed table segment 1*a* and 1*b*.

Control of the feeding of the slivers and of the feeding-in of the reserve slivers corresponds to the embodiment shown in FIGS. 1 and 3 and will not be further described here. For starting and in operation the two motors 12 are electrically interconnected to ensure simultaneous or uniform feeding of the slivers into the drawframe 6.

Another embodiment of the invention provides for the conveyor belt 8*a* associated with the reserve sliver 7 to be disposed vertically above or below the belt 8 associated with the sliver 2 (not shown). The leading end of the reserve sliver then converges with the running-out end of the sliver 2 immediately after the delivery station 11.

The construction according to the invention is suitable for the uniform mixing of various fiber components, for example, of cotton and synthetic fibers.

The division of the conveyors into individual conveyor belts arranged in groups enables the divided feed zone to be better adapted to conditions of space, i.e., the apparatus can be adapted even to relatively small spaces. In the case of a division, for example, into two groups, each group can be provided for a particular fiber component to make a mix.

The division of the conveyor belts into two groups, for example, prevent errors in the feeding-in of reserve cans and the control is better.

FIGS. 5 to 15 show details of the feed table 1 with its conveyor belts 8, 8*a* which are separate from each other, guided on deflecting rolls 30 and moved in the conveying direction z by drive rollers 32. The conveying belts 8, 8*a* have a breadth b of, for example, 40 mm.

Unlike the arrangement shown in FIG. 1, the drive roller 32 is not arranged near the motor 12 at the transfer location 11, but instead forms part of a module-like drive unit 34. This unit 34 comprises its own integrated drive means. Drive unit 34 is located at the infeed end 35 of a substantially horizontal support 38 which is made up from a plurality of support sections 38*a*, 38*b*, 38*c*. In accordance to FIG. 5, these sections are provided in three different lengths, $N_1$, $N_2$ and $N_3$ in order to be able to assemble as many different overall lengths N of this support 38 as possible. The length $N_1$ of the support section 38*a* corresponds to half the length $N_3$ of the support section 38*c*, and the length $N_2$ of the support section 38*b* corresponds to one and a half times the length $N_1$.

Figure 12:
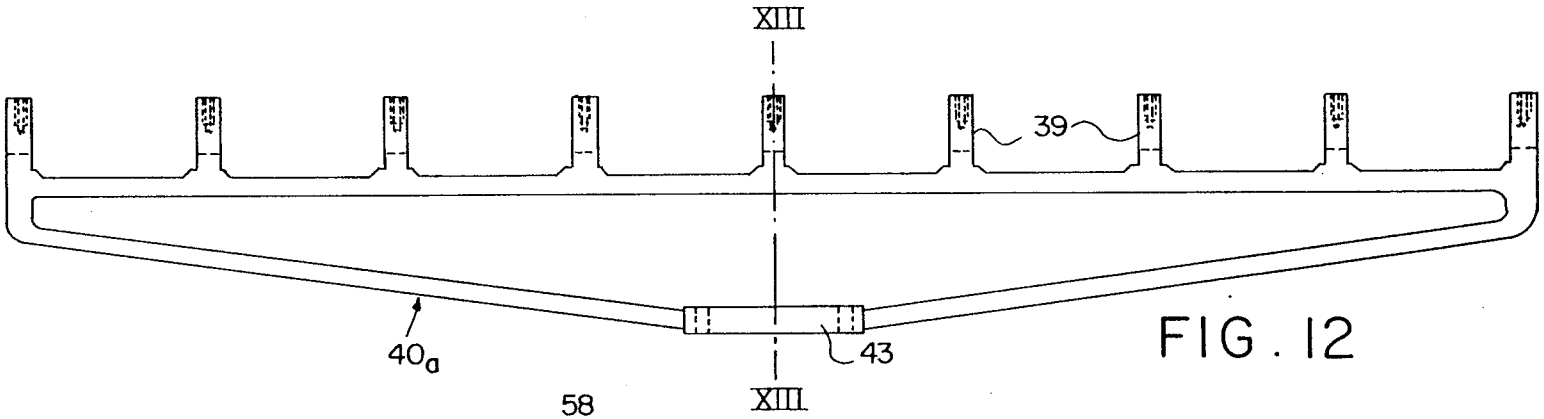
FIG. 12 is a view of a further embodiment of the transverse support according to FIG. 11.

The supports 38 are assembled in graduated overall lengths N from these support sections 38*a*, 38*b*, 38*c*, and these supports rest on common transverse carriers 40, 40*a*. In the embodiment according to FIG. 11, the transverse carrier 40 comprises a carrier plate 41 and yokes 42 and this transverse carrier rests on two vertical posts 44. In contrast, the transverse carrier 40*a* in FIG. 12 is made in one piece and is screwed to a post 44 in the region of a support surface 43.

Each support 38 forms an exchangeable unit comprising the drive unit 34 and the deflector roll 30 mounted at the opposite end. This support 38, together with the transverse carriers 40, 40*a* and the vertical posts 44 (the foot portions of which have been omitted from the drawings), form part of a frame work 46 of the feed table 1.

The lower run 8*t* of the conveyor belt 8 or 8*a* running between the deflector roll 30 and drive roll 32 rests in the region of the transverse carriers 40, 40*a* on support rollers 48 which prevent sagging of the unsupported lengths of the slivers.

Figure 11:
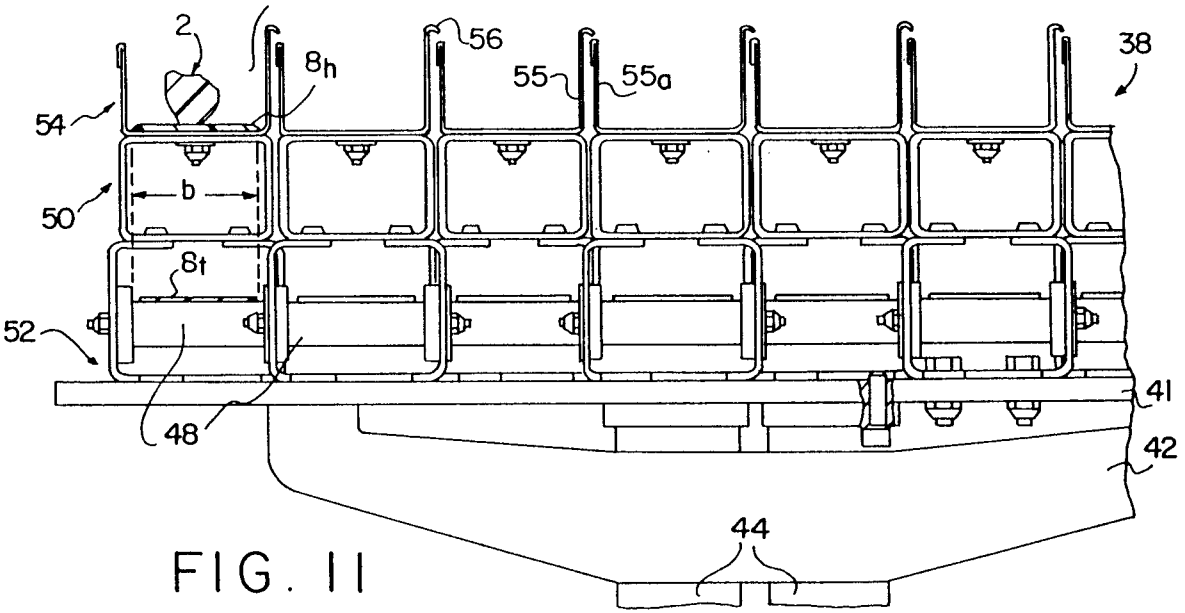
FIG. 11 is a transverse view of a support of the frame forming part of FIG. 8 and is illustrated in enlarged elevation.
Figure 13:
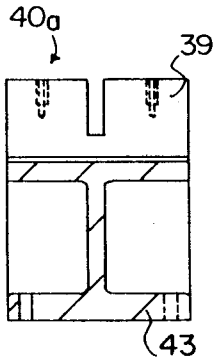
FIG. 13 is a sectional view of FIG. 12, taken along lines XIII—XIII.

In the arrangement according to FIG. 11, these supports 38 or support sections 38*a*, 38*b*, 38*c* have a supporting tubular section 50 underneath of which a tubular or trough-shaped projection 52 is riveted or screwed. This projection receives each supporting roll 8. A U-shaped section 54 is mounted on the tubular section 50 and has leg elements 55, 55*a*, flanking the upper run 8*h* of the conveyor belt 8, 8*n* running in the interior 58 of the section 54. These elements also protect the fiber sliver 20 resting on the upper run 8*h*. The trough-projection 52 protects the lower run 8*t* in the same way. The section of the one section element 55 of the U-shaped section 54 is longer than that of the other section element 55*a* and a bentover portion 56 of this element 55 projects over the edge of the neighboring section element 55*a* in order to form an interlinked unit with the U-shaped section 54 having this element 55*a*.

In FIG. 11, the supports 38 are screwed to the carrier plate 41, whereas in FIG. 12 they are inserted between projections 39 of the transverse carrier 40*a*. These projections form a castellated shape. Furthermore, it is apparent from FIG. 11 that the tubular or trough-shaped projections 52 extend only over a portion of the support length N or $N_1$, $N_2$, $N_3$. In the illustrated example, they are arranged one after the other in the transport direction z with mutually overlapping cross sections.

Figure 14:
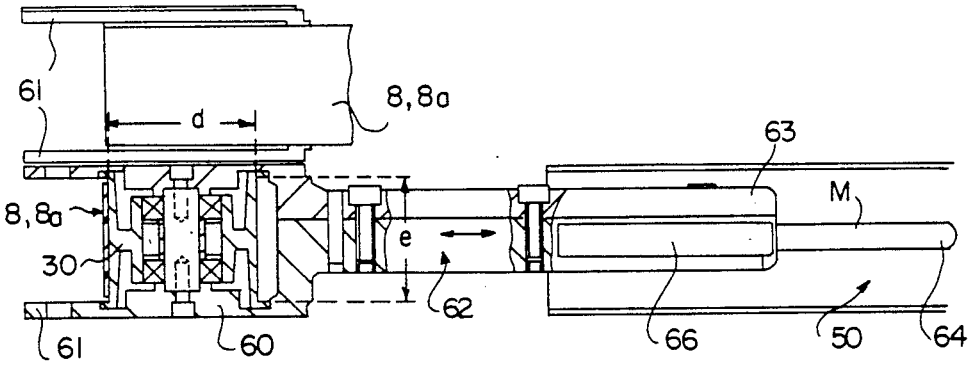
FIG. 14 is a detailed sectional view of a deflecting roll for a conveyor belt, illustrated in partially sectioned plan.

In order to tension the conveyor belt 8, 8*a* (as seen in FIG. 14), the deflector roll 30 is mounted in fork-shaped bearing members 60 of an adjustable arm 62 supported on the tubular profile 50 and axially movable along the longitudinal axis M thereof. The arm can be fixed in place for example by screws which are received in a mounting portion 66 and extend through a longitudinal slot 64 of the tubular section 50. The deflector roll 30 can, for example, have a diameter d of 50 mm and a circumferential breadth e of, in this case, 42 mm.

The adjusting arm 62 is divided in the longitudinal direction in order to enable easier exchangeability of the deflector roll 30 provided between two cheek plates 61 of the bearing members 60 (FIG. 14).

Figure 15:
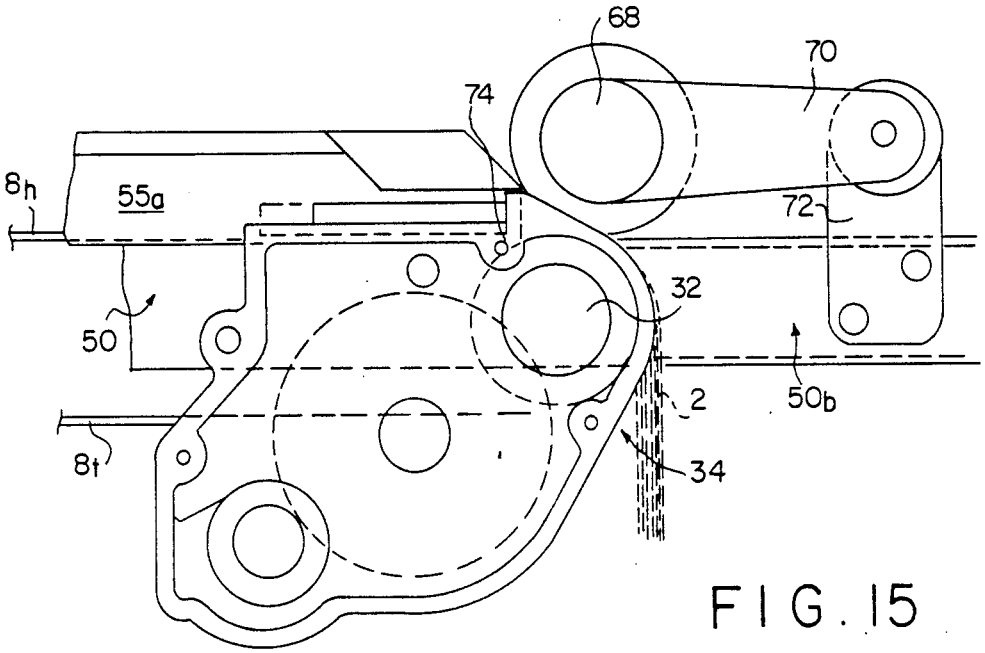
FIG. 15 is an enlarged side view of a drive wheel for a conveyor belt illustrated as an enlarged detail of an arrangement according to FIG. 7.

As can be seen especially from FIG. 15, the drive unit is secured to the feed end 35 of a tubular section 50. A pressure roll 68 rests on the circumference of the drive roll 32 of the unit 34 (or on a fiber sliver 20 running over this drive roll 32) and is linked by means of a pivot arm 70 to a lug 72 of the adjacent support 50*b*. A sensor 74 integrated in the drive unit 34 or, in accordance with FIG. 8, otherwise arranged in the infeed region, controls the belt movement in dependence upon the throughput of fiber sliver 2.

In changing of the conveyor belt 8, 8*a*, the support 38 is lifted away from its transverse carrier 40, 40*a* and the variably positioned diverter roll 30, which serves as a tensioning roll, is released. After mounting of a new conveyor belt 8, the new belt is tensioned by the diverter roll 30 and the support 38 is then reset in place.

We claim:

1. A feed table for continuously feeding slivers to a textile processing machine, comprising:

(a) a plurality of sliver cans arranged in a row for supplying primary slivers to said textile processing machine;

(b) a plurality of reserve sliver cans disposed adjacent to said sliver cans for supplying reserve slivers to said textile processing machine;

(c) a first narrow flexible conveyor belt for each of said primary slivers, said conveyor belts being supported by a driven roller and an idler roller for conveying said slivers to a common delivery point;

(d) a second flexible conveyor belt for each of said reserve slivers, said conveyor belts being supported by a driven support roller and an idler roller, adjacent to said first conveyor belt for alternately conveying said reserve slivers to said common delivery point;

(e) first detection means for detecting the presence of each of said primary slivers and said reserve slivers, individually;

(f) second detection means for detecting the absence of said primary slivers and said reserve slivers, individually;

(g) a continuously driven common conveyor belt for receiving said slivers at said common point and for conveying said slivers to said textile processing machine; and (h) control means for receiving signals from said first and second detecting means, including means for selectively driving said driven rollers of said first and second conveyor belts to alternately deliver said primary sliver or its adjacent reserve sliver to said common point on said common conveyor, said control means commencing the delivery of a leading end of said reserve sliver to said common point at the same time that a trailing end of said primary sliver passes said common delivery point.

2. A table as set forth in claim 1, wherein said first and second conveyor belts are disposed parallel to one another in pairs.

3. A table as set forth in claim 1, wherein one end of said first conveyor belt is disposed adjacent to a can of said primary sliver and one end of said second conveyor belt is disposed adjacent to one end of a can of reserve sliver, and the other ends of said first and second conveyor belts reverse their direction of movement at said common point.

4. A table as set forth in claim 1, wherein said ends of said first and second conveyor belt reverse their direction at said cans about one of said driven support rollers and further comprise a pivoted pressing roller adjacent each end of said first and second conveyor belts for cooperating with said driven support rollers in withdrawing slivers from said cans.

5. A table as set forth in claim 4, wherein said pivoted pressing roller engages the drive of its conveyor belt.

6. A table as set forth in claim 3, wherein said driven support rollers for said first and second conveyor belts are disposed on a common shaft adjacent to said common delivery point and said driven support rollers are individually connected to said common shaft by individual clutches selectively actuated by said control means.

7. A table as set forth in claim 6, wherein a braking device is associated with each of said clutches for stopping said driven support rollers for each of said first and second conveyor belts, each braking device activated by said control means whenever its associated clutch is deactivated.

8. A table as set forth in claim 4, wherein said first and second conveyor belts each have inwardly directed tooth shapes and each of said driven support rollers have outwardly directed tooth shapes for interlocking with, and receiving, the inwardly directed tooth shapes on said conveyor belts.

9. A table as set forth in claim 1, wherein said first and second conveyor belts have an anti-static and non-sticking surface for fibers.

10. A table as set forth in claim 1, wherein each of said first and second detection means comprises a sensor disposed adjacent to each of said driven first and second conveyor belts.

11. A table as set forth in claim 10, wherein said first and second detection means are disposed in the region before said common delivery point and after the last of said sliver cans closest to said textile processing machine.

12. A table as set forth in claim 1, wherein said first and second conveyor belts are disposed in substantially the same horizontal plane.

13. A table as set forth in claim 1; wherein said first and said second conveyor belts are disposed in different horizontal planes.

14. A table as set forth in claim 1, wherein said first and second conveyor belts comprise a plurality of associated first and second conveyor belts, disposed in at least two different groups, each of said groups extending to said common delivery point at an angle different from the angle of adjacent groups.

15. A table as set forth in claim 1, wherein said first and second conveyor belts are spaced from adjacent conveyor belts by a guide means extending between said first and second conveyor belts.

16. A table as set forth in claim 1, further comprising guide means disposed adjacent to said common conveyor for guiding said primary slivers into a web wherein each of said primary slivers abut adjacent primary slivers.

17. A table as set forth in claim 16, wherein said guide means associated with said common conveyor comprises guides to guide the leading end of said reserve sliver into abutting contact with the trailing end of said primary sliver.

18. A table as set forth in claim 16, wherein said guide means comprises pressure rollers which cooperate with said common conveyor belt.

19. A table as set forth in claim 1, wherein said driven support rollers are mounted on an associated support frame.

20. A table as set forth in claim 19, wherein one of said driven support rollers is axially movable on said support to provide means for tensioning said conveyor belts.

21. A table as set forth in claim 19, wherein said support frame comprises a tubular section and a U-shaped section mounted thereon with one run of said conveyor belts disposed in the interior of said U-shaped section.

22. A table as set forth in claim 21, further comprising a tubular shaped section disposed beneath said U-shaped section and including at least one driven support roller for guiding the other run of said conveyor belts.

23. A table as set forth in claim 1, wherein said support driven rollers are supported by axial support sections encircled by said conveyor belts.

24. A table as set forth in claim 23, wherein said support sections have variable lengths.

25. A table as set forth in claim 23, wherein a plurality of supports are attached to a common carrier to form said feed table.

26. A table as set forth in claim 1, wherein the drive for each of said conveyor belts is provided with a drive unit supported on said feed table adjacent to one of said driven support rollers for said conveyor belt.

27. A table as set forth in claim 26, wherein said drive means comprises at least one pressure roller pivoted into contact with said driven roller and forms a part of said drive means.

28. A table as set forth in claim 1, wherein at least one pressure roller is pivoted into contact with said conveyor belts where said conveyor belts contact said driven support roller.

29. A table as set forth in claim 27, wherein said pressure roller is disposed on a pivot arm.

30. A table as set forth in claim 1, wherein said idler roller is rotatable in a varying member on an adjustable arm projecting axially downwardly from a support member.

31. A feed table for continuously feeding slivers to a textile processing machine, comprising:

a) a plurality of sliver cans arranged in a row for supplying primary slivers to said textile processing machine;

b) a plurality of reserve sliver cans disposed adjacent to said sliver cans for supplying reserve sliver cans for supplying reserve slivers to said textile processing machine;

c) a first narrow flexible conveyor belt for each of said primary slivers, said conveyor belts being supported by rollers for conveying said slivers to a common delivery point;

d) a second flexible conveyor belt for each of said slivers, said conveyor belts being supported by rollers adjacent to said first conveyor belt, for alternately conveying said reserve slivers to said common delivery point;

e) first detection means for detecting the presence of each of said primary slivers and said reserve slivers, individually;

f) second detection means for detecting the absence of said primary slivers and said reserve slivers, individually;

g) a continuously driven common conveyor belt for receiving said slivers at said common point and for conveying said slivers to said textile processing machine; and h) control means for receiving signals from said first and second detecting means, including means for selectively driving said first and second conveyor belts to alternately deliver said primary sliver or its adjacent reserve sliver to said common point on said common conveyor, said control means commencing the delivery of a leading end of said reserve sliver to said common point at the same time that a trailing end of said primary sliver passes said common delivery point.

* * * * *